US008613523B2

(12) United States Patent
Bouffay et al.

(10) Patent No.: US 8,613,523 B2
(45) Date of Patent: Dec. 24, 2013

(54) PORTABLE ELECTRIC LIGHTING LAMP WITH IMPROVED FIXING

(75) Inventors: Boris Bouffay, Saint Bernard du Touvet (FR); Frederic Piu, Pontcharra (FR); Christophe Chedal-Anglay, Cren Gevrier (FR)

(73) Assignee: ZEDEL, Crolles (FR)

( * ) Notice: Subject to any disclaimer, the term of this patent is extended or adjusted under 35 U.S.C. 154(b) by 47 days.

(21) Appl. No.: 13/356,161

(22) Filed: Jan. 23, 2012

(65) Prior Publication Data

US 2012/0195026 A1 Aug. 2, 2012

(30) Foreign Application Priority Data

Feb. 1, 2011 (FR) ..... 11 00302

(51) Int. Cl.
*F21V 21/084* (2006.01)

(52) U.S. Cl.
USPC ..... 362/105; 362/106

(58) Field of Classification Search
CPC ... F21V 21/084; F21V 21/885; H05B 33/842; G09F 9/33
USPC ..... 362/105, 106, 277, 555; 224/181; 340/815.45, 845.65
See application file for complete search history.

(56) References Cited

U.S. PATENT DOCUMENTS

| | | | |
|---|---|---|---|
| 4,794,496 | A | 12/1988 | Lanes et al. |
| 2005/0276036 | A1 | 12/2005 | Miles et al. |
| 2008/0298048 | A1 | 12/2008 | Garrity et al. |
| 2009/0323317 | A1 | 12/2009 | Spartano et al. |

FOREIGN PATENT DOCUMENTS

| | | | |
|---|---|---|---|
| DE | 20 2005 013 598 | U1 | 12/2005 |
| FR | 2 305 684 | A1 | 10/1976 |
| FR | 2 833 069 | A1 | 6/2003 |

*Primary Examiner* — Tracie Y Green
(74) *Attorney, Agent, or Firm* — Oliff & Berridge, PLC

(57) ABSTRACT

A lamp comprises a lighting module mounted on a front housing, an electric power supply device connected to the lighting module, a rear pressing part, and means for fixing. The latter comprise a flexible link fixed to the rear pressing part, a securing device having gripping means, means for tensioning, and sliding means of the link designed to move the front housing and the rear pressing part towards one another. The flexible link is formed by a cord, a lace, or a flexible wire, and the gripping means of the securing device are centralized on the rear pressing part.

8 Claims, 7 Drawing Sheets

PORTABLE ELECTRIC LIGHTING LAMP WITH IMPROVED FIXING

BACKGROUND OF THE INVENTION

The invention relates to a portable electric lighting lamp, in particular a headlamp, comprising a lighting module fitted in a front housing, an electric power supply device electrically connected to the lighting module, a rear pressing part, and means for fixing the lamp on the user's head joining the front housing and the rear pressing part. Said means for fixing comprise:

a flexible link fixed to the rear pressing part, and a securing device having gripping means, and means for tensioning at the end of blocking, and sliding means of said link to move the front housing and the rear pressing part towards one another.

STATE OF THE ART

In usual manner, a portable electric lighting lamp of headlamp type is provided with an elastic fixing band achieved by means of a strap. The band joins the front housing, on which the lighting module is mounted, and the rear pressing part accommodating the electric power supply. Such a device is known and is described in the document DE 20 2005 013 598 U1.

The documents FR 2833069 and US 2009/0323317 mention a headlamp using a securing device with straps arranged between the front lighting housing and the rear electric power supply housing. The securing device comprises a first flat elastic strap in the form of a band surrounding the user's head, and a second flat strap passing across the middle of the user's head. Adjustment is performed by means of loops enabling the length of the straps to be adjusted.

A more or less large section of the band can be doubled up so as to enable adjustment of its main dimension and to adapt to fit different head sizes. The band is equipped for this purpose with an adjustment loop, but symmetric adjustment has to be performed in two steps with a single loop located off-center to the right or to the left.

This type of known solution does however present certain limits relating in particular to the use of the band with a flat strap. The latter in fact presents a relatively large transverse dimension, or width, so as to cover a large area of the user's head. The presence of this band can therefore prove inconvenient under certain conditions, for sweat to be able to be removed.

Such a known band does not "breathe" well, lacks stability on the user's head, and does not facilitate centering of the lamp when adjustment is performed.

OBJECT OF THE INVENTION

The object of the invention is to remedy the shortcomings of the above-mentioned prior art and to provide a portable electric lighting lamp that is comfortable to use, easy to fit on, and has a good stability on the user's head.

The lamp according to the invention is remarkable in that the flexible link is formed by a cord, a lace, or a flexible wire, and that the gripping means of the securing device are centralized on the rear pressing part.

In accordance with the invention, the use of an attachment link of flat or round lace or cord type makes it possible to palliate the limits of the band used in the prior art. Indeed, as such a link presents a much smaller cross-section than the width of a conventional band, the area it covers on the user's head is much smaller than that of the band. This element does not therefore significantly hamper evacuation of sweat, which moreover prevents any nuisance sliding of the lamp. The gripping means of the securing device being advantageously centralized on the rear pressing part, a simple pull on the gripping means achieves both blocking of the securing device and symmetrical positioning of the front housing containing the lighting module.

The flexible link can also be subdivided into two elementary parts collaborating with associated clamps.

It is also possible to provide a winder fixed onto the rear pressing part.

The lamp according to the invention can comprise all or part of the following features taken either alone or in any technically compatible combination:

the flexible link is formed by a non-stretchable cord, a flexible wire, or a lace;

the gripping means are formed by a loop of the link which is salient over a variable length with respect to a blocking surface of the pressing part;

the means for tensioning comprise blocking means presenting a blocking position of the link and a free movement position;

the blocking means are able to press against the blocking surface of the pressing part;

the sliding means comprise at least one groove receiving the flexible link, said groove being arranged in the front housing or in a link member supported by this front housing;

each end of the link is provided with a pad pressing against the user's head;

the electric power supply device is connected to the housing by a power supply cable having a winding area, the link extending at least partially inside the winding area;

the means for fixing further comprise at least one intermediate strap joining the front housing and the link, the strap and/or the link being made from a flexible material.

BRIEF DESCRIPTION OF THE DRAWINGS

Other advantages and features will become more clearly apparent from the following description of a particular embodiment of the invention given for non-restrictive example purposes only and represented in the appended drawings, in which:

DESCRIPTION OF A PREFERRED EMBODIMENT OF THE INVENTION in the following, the terms "front", "rear", "top", "bottom", "horizontal" and "vertical" are relative to a lamp worn by a user in the standing position, with his/her head held straight. As shown in FIG. 1, the headlamp 1 according to the invention first of all comprises a front lighting module 10 fitted in a front housing 12 resting against the user's forehead, as illustrated in FIG. 2. The lighting module comprises at least one or two light generators 14, for example of light-emitting diode LED or other type. These different elements do not form part of the invention and will therefore not be described in greater detail. In a manner known as such, lamp 1 further comprises a rear device 20 which is connected to module 10 by a cable 22 so as to provide an electric power supply. This rear device 20 is fitted on a triangular-shaped pressing part 26 which will be described in greater detail in the following.

Figure 1:
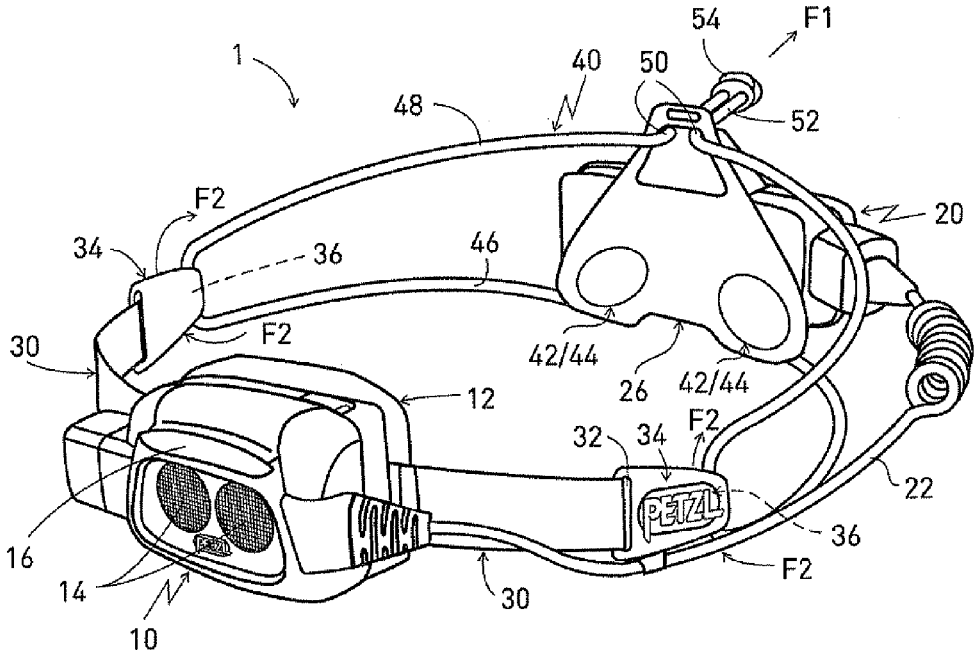
FIG. 1 is a perspective view of a lamp according to the invention.

Front housing 12 and rear pressing part 26 are connected by means for fixing lamp 1 on the user's head. These means for fixing first of all comprise two straps 30 extending on each side of housing 12, in substantially horizontal manner when the lamp is worn. It should be noted that these straps are relatively short, i.e. that they only cover a small part of the head, in use. At its end opposite the plate, each strap is fed into a slot 32 belonging to a connecting brace 34. Each brace further defines a groove 36, in its rear part, for passage of an element in the form of a wire or a flexible link 40.

Flexible link 40 has two ends 42 each of which is fixed onto rear pressing part 26. Each end 42 is terminated by a pad 44 that both immobilizes the latter with respect to pressing part 26 and provides a comfortable contact for the user. Link 40 then defines two first intermediate strands 46 connecting a pad and a corresponding groove 36, as well as two other intermediate strands 48 connecting each groove with the apex of the pressing part. It should be noted that strands 46 and 48 extend side by side between the return groove and the pressing part.

The two strands 48 then enter holes 50 arranged in pressing part 26 so as to form a loop 52. The latter collaborates with a jammer 54, of a type known as such, that has a blocked position on the loop and a free sliding position along this loop so as to be selectively secured at different locations of the latter.

Link 40 is of isolated type, i.e. it is not connected to another identical element, in particular by weaving. In advantageous manner, it has a relatively small transverse dimension, for example comprised between 3 and 10 mm. Straps 30, like link 40, can be either elastic or axially non-stretchable while at the same time having a certain lateral flexibility so as to be folded onto itself. Strap 30 is for example formed by a usual woven section, whereas the flexible link is for example formed by a non-stretchable cord, or by a flexible wire, or by a lace.

The invention thus covers three possibilities to achieve the means for fixing, i.e. straps 30 and a link 40 both of which are flexible, or non-stretchable straps and the flexible link, or flexible straps and the non-stretchable link.

The user first of all places front housing 12 and rear pressing part 26 around his/her head in the final configuration they are to adopt. Then he/she pulls on loop 52, which forms a gripping means, in the direction of arrow F1 in FIG. 1. This results on the one hand in making link 40 slide along grooves 36 in the direction of arrows F2 and on the other hand in tensioning the means for fixing forms by the straps and the link. This results in front housing 12 and rear pressing part 26 moving towards one another. The user then keeps the loop in the required position, and then slides jammer 54 until it comes up against the stop formed by rear surface 26' of pressing part 26, in the direction of arrow F3 in FIG. 2. Finally he/she resecures the jammer on loop 52 so that the link is secured in this position.

Figure 2:
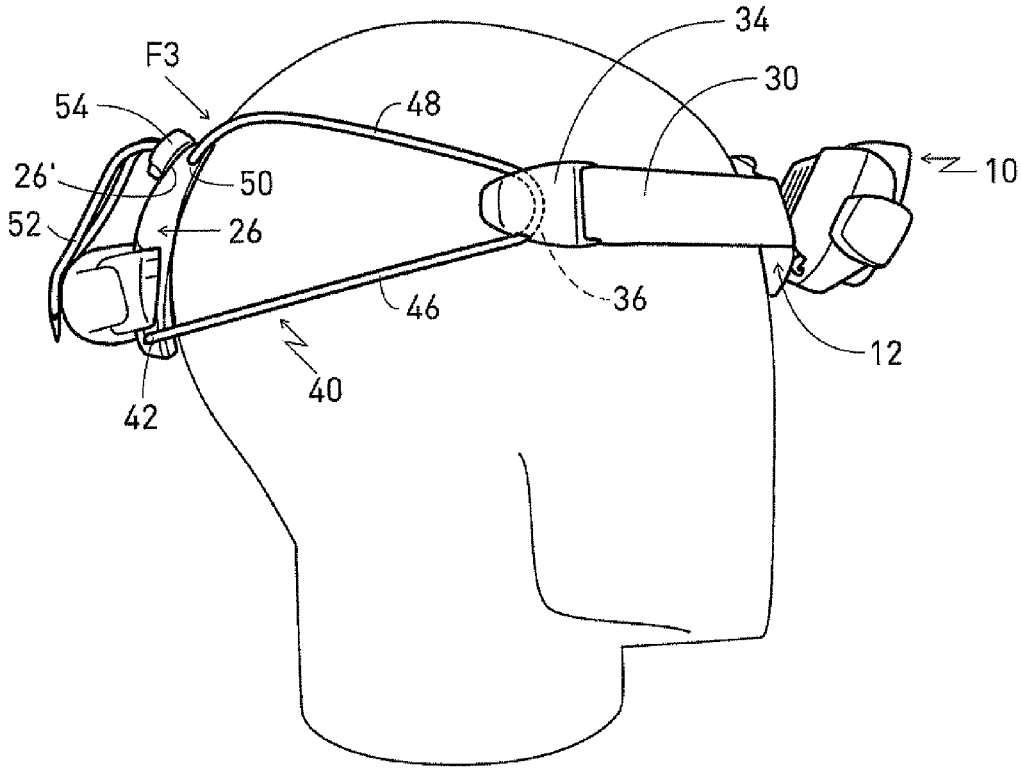
FIG. 2 is a side view illustrating the lamp of FIG. 1 in the use position.
Figure 3:
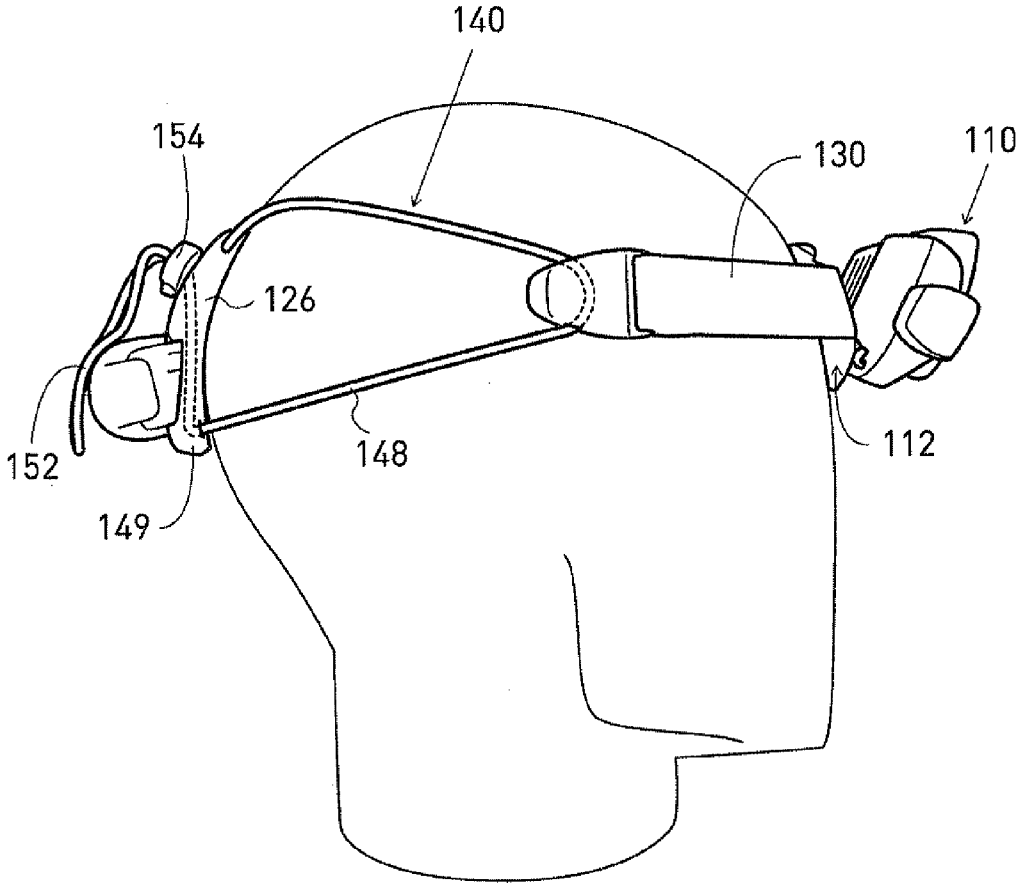
FIGS. 3 to 7 are side views, similar to FIG. 2, illustrating different alternative embodiments of the lamp according to the invention.

FIG. 3 and the following illustrate alternative embodiments of the invention. In each figure, the same reference numerals are assigned to the mechanical parts that are the same as those of FIGS. 1 to 2, incremented by 100 in FIG. 3, 200 in FIG. 4 . . . up to 500 in FIG. 7.

In FIG. 3, loop 152 of the element in the form of a wire or link 140, and also jammer 154 that is associated with the latter, are also placed at the top part of pressing part 126. Each intermediate strand 148 forming this terminal loop on the other hand extends along the bottom part and then runs along a return groove 149 arranged on the support.

Figure 4:
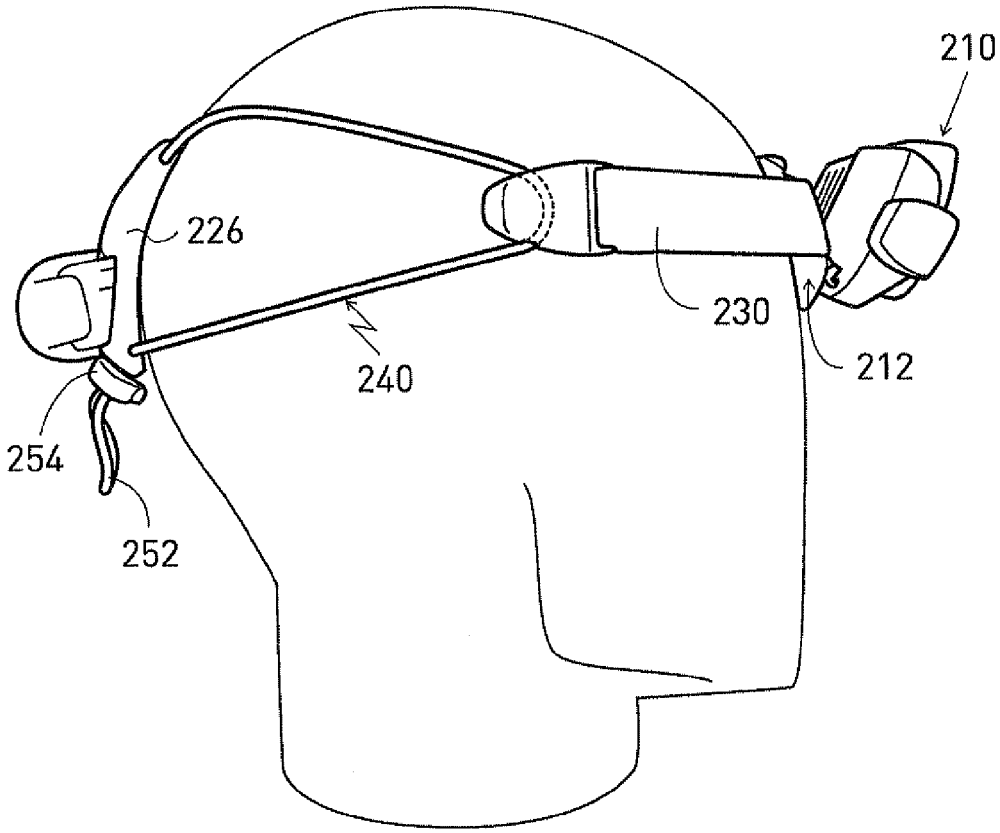

In FIG. 4, loop 252 of flexible link 240, and also jammer 254 that is associated with the latter, are placed at the bottom part of pressing part 226. In this case, this pressing part is for example arranged in symmetrical manner with respect to part 26 of FIG. 1, i.e. its apex is directed downwards.

Figure 5:
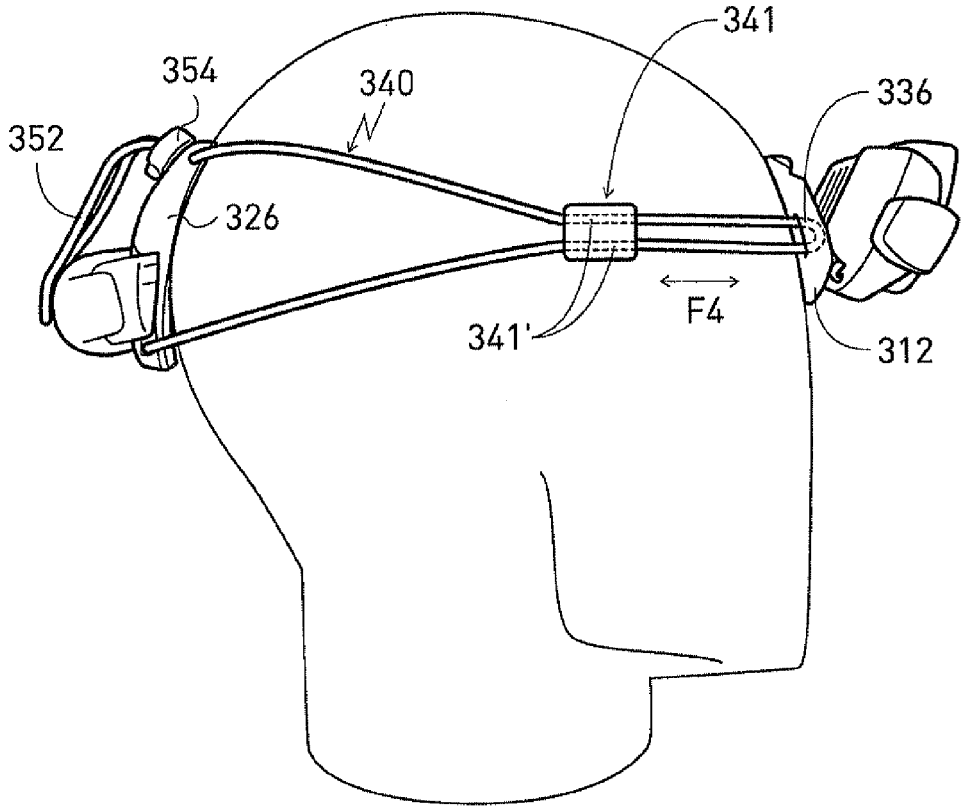

In FIG. 5, flexible link 340 presents larger dimensions than those of part 40, i.e. it extends substantially over the whole circumference of the user's head, whereas the straps are eliminated. Under these conditions, this part is directly connected to front housing 312, with for example a possibility of sliding along a groove 336 arranged in this housing. To ensure reliable fixing, it is then preferred for this part 340 to be elastic.

In advantageous manner, the user can adjust the tension of link 340, even after he/she has fitted the jammer in its final position. For this purpose, a strip 341 is provided, having two channels 341' along which the two strands of the link can slide. It can be conceived that, by moving this strip along these strands in the direction of double arrow F4, the tension exerted on the link is modified. It should however be noted that the presence of this adjustment strip is optional.

Figure 6:
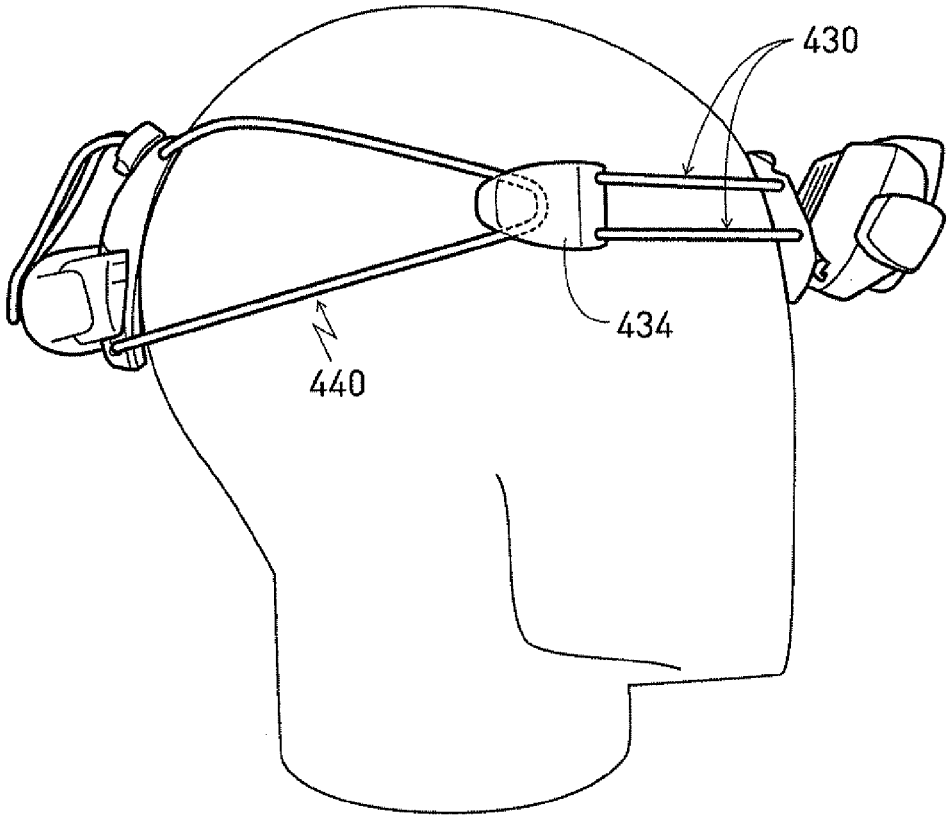

In FIG. 6, strap 30 of FIGS. 1 to 3 is replaced by two other elements 430 in the form of wires having the same transverse dimensions as those of main element 440.

Figure 7:
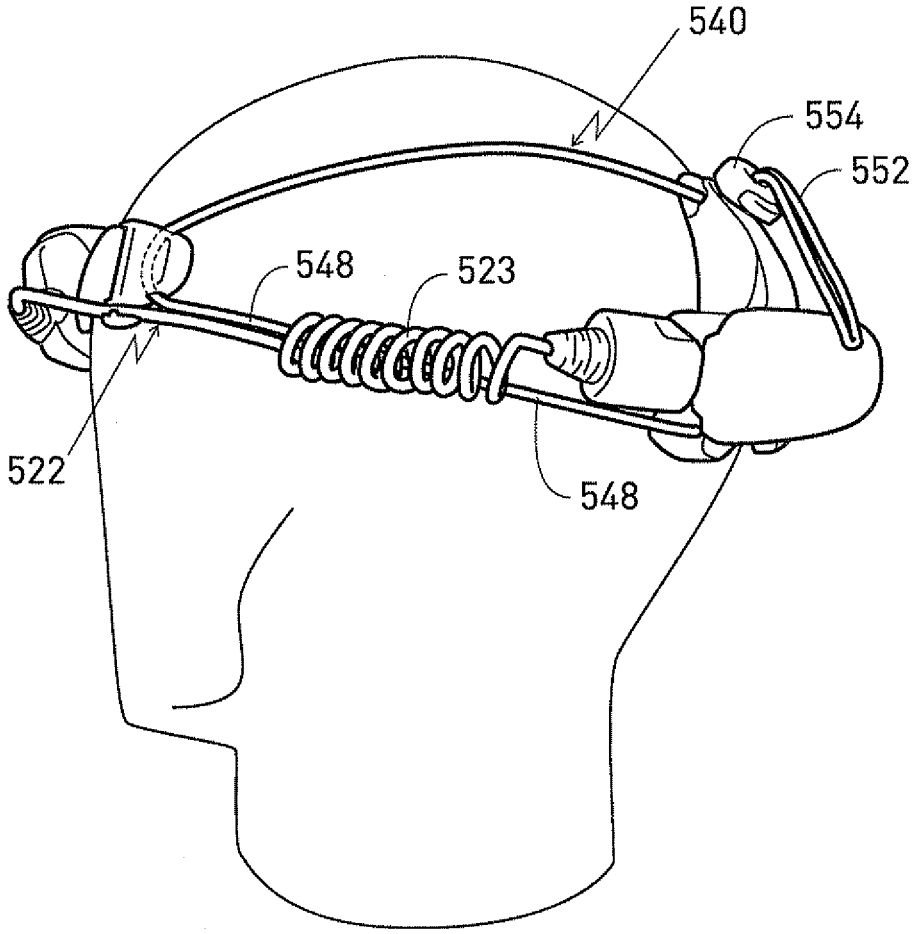

FIG. 7 illustrates a particularly advantageous embodiment of the invention wherein one of strands 548 of link 540 extends in winding 523 of power supply cable 522. This enables the latter to be kept in position so as to prevent any premature wear and any untimely damage.

The invention is not limited to the examples described and represented. It is thus first possible to provide for the power supply device not to be fitted on the rear pressing part. In this case, the latter can be formed by a simple plate on which a rear safety light can be placed, in particular for cyclists. It is further possible to provide for a storage pocket for the gripping loop and the excess part of the link to be arranged on the rear pressing part.

The power supply device with disposable or rechargeable batteries can also be housed in front housing 12 or in an external housing connectable to lighting module 10 by an electric connection.

The securing device can also be equipped with a winder fixed onto rear pressing part 26.

The securing device can also be subdivided into two elementary parts collaborating with associated jammers.

The invention claimed is:

1. A portable electric headlamp for use by a user, comprising:

a lighting module fitted in a front housing, an electric power supply device connected to the lighting module, a rear pressing part, and means for fixing the lamp on the user's head joining the front housing and the rear pressing part, said means for fixing including:

a flexible link formed by a cord or a lace, and having first ends which are fixed to the rear pressing part, a securing device having gripping means attached to second ends of the link, the gripping means being centralized on the rear pressing part, and and sliding means causing the link to slide after pulling the gripping means so as to move the front housing and the rear pressing part towards one another.

2. The headlamp according to claim 1, wherein the securing device comprises a winder fixed onto the rear pressing part.

3. The headlamp according to claim 1, wherein the gripping means are formed by a loop of the second ends of the link, said loop being salient over a variable length with respect to a blocking surface of the pressing part.

4. The headlamp according to claim 1, wherein the securing device comprises blocking means arranged to occupy either a blocking position of the link or a free movement position of said link.

5. The headlamp according to claim 1, wherein the sliding means comprise at least one groove receiving the flexible link, said groove being arranged in the front housing or in a connecting brace supported by this front housing.

6. The headlamp according to claim 1, wherein the electric power supply device is connected to the housing by a power supply cable having a winding area, the link extending at least partially inside the winding area.

7. The headlamp according to claim 1, wherein the means for fixing further comprise at least one intermediate strap joining the front housing and the flexible link, the intermediate strap and/or the link being made from a flexible material.

8. The headlamp according to claim 1, wherein the flexible link is made from an elastic material.

* * * * *